United States Patent [19]

Ploog et al.

[11] Patent Number: 4,877,539

[45] Date of Patent: Oct. 31, 1989

[54] TEXTILE TREATMENT PREPARATIONS CONTAINING A FATTY ACID AND HYDROXYALKYL-AMINE CONDENSATE PREPARED IN THE PRESENCE OF DISPERSION ACCELERATOR

[75] Inventors: Uwe Ploog, Haan; Guenter Uphues, Monheim, both of Fed. Rep. of Germany

[73] Assignee: Henkel Kommanditgesellschaft auf Aktien, Duesseldorf, Fed. Rep. of Germany

[21] Appl. No.: 243,956

[22] Filed: Sep. 13, 1988

[30] Foreign Application Priority Data

Sep. 14, 1987 [DE] Fed. Rep. of Germany ..... 3730792

[51] Int. Cl.[4] ..... C11D 1/52; C11D 3/20; D06M 13/40

[52] U.S. Cl. ..... 252/8.8; 252/8.6; 252/89.1; 252/174.17; 252/544; 8/137

[58] Field of Search ..... 252/8.8

[56] References Cited

U.S. PATENT DOCUMENTS 4,786,439 11/1988 Plodg et al. ..... 252/544

*Primary Examiner*—A. Lionel Clingman

*Attorney, Agent, or Firm*—Ernest G. Szoke; Wayne C. Jaeschke; Real J. Grandmaison

[57] ABSTRACT

Textile treatment preparations are obtained by reaction of aliphatic monocarboxylic acids or amide-forming derivatives thereof with hydroxyalkylpolyamines and subsequent neutralization of unreacted amino groups and which contain monosaccharides or polyhydroxy compounds derived therefrom by hydrogenation and also synthetic or natural polymers as dispersion accelerators which may be dispersed particularly rapidly, even in cold water, if the dispersion accelerator is present in the reaction mixture during the actual reaction.

20 Claims, No Drawings

TEXTILE TREATMENT PREPARATIONS CONTAINING A FATTY ACID AND HYDROXYALKYL-AMINE CONDENSATE PREPARED IN THE PRESENCE OF DISPERSION ACCELERATOR

BACKGROUND OF THE INVENTION

1. Field of the Invention:

This invention relates to textile treatment preparations based on condensation products of carboxylic acids or carboxylic acid derivatives with hydroxyalkyl polyamines. The preparations show particularly good dispersibility in water through the addition of dispersion accelerators which are present in the reaction mixture during the condensation reaction. The invention also relates to a process for the production of the textile treatment preparations and to their use. In the context of the invention, textile treatment preparations are understood to be products which may be used in preparations for the finishing of fibers and yarns, in detergents and in aftertreatment preparations for washed fabrics.

2. Discussion of Related Art:

Several compounds or mixtures of compounds have been proposed for the treatment of textile fibers, yarns or fabrics, providing the textiles thus treated with particularly valuable properties or as part of preparations for the particularly effective care of textiles. The processing properties, the wear properties of the textiles and also their care can be improved, depending on the active substances used. U.S. Pat. No. 2,340,881, for example, describes condensation products prepared from a hydroxyalkyl polyamine and a fatty acid glyceride. These condensation products improve the slipping properties and softness of the textiles thus treated. According to the teaching of this patent, the condensates are used in the form of aqueous dispersions. U.S. Pat. No. 3,454,494 relates to fatty acid condensation products containing an addition of dispersing polyoxyalkylene compounds. U.S. Pat. No. 3,689,424 describes detergents containing fatty acid condensation products which contain dispersing fatty acid partial glycerides from their production. U.S. Pat. No. 3,775,316 describes the same fatty acid condensation products as fabric softeners, more especially for liquid laundry aftertreatment preparations. These and similar textile treatment preparations may be dispersed in water be heating the water and generally applying intense shear forces or by dispersing the condensation product still molten from its product in water. On account of the work involved, therefore, the manufacturer normally undertakes dispersion and supplies the user with the dispersions which involve the transport of considerable quantities of water. According to the teaching of German patent application P 35 30 302.6, hydrophilic dispersion accelerators are added to active substances of the type herein to improve dispersibility. However, there is still a need for fabric treatment preparations based on fatty acid condensation products which show improved dispersibility, above all in cold water, so that the users are themselves readily able to undertake dispersion of the textile treatment preparations.

DESCRIPTION OF THE INVENTION

Other than in the operating examples, or where otherwise indicated, all numbers expressing quantities of ingredients or reaction conditions used herein are to be understood as modified in all instances by the term "about".

The afore-noted drawbacks of the prior art have been solved by a textile treatment preparation obtained by reaction of (a) aliphatic $C_8$–$C_{22}$ monocarboxylic acid or amide-forming derivatives thereof with (b) hydroxyalkyl polyamines and subsequent neutralization of unreacted amino groups, the textile treatment preparation containing an addition of dispersion accelerators selected from the group consisting of monosaccharides of the aldose and ketose type and the polyhydroxy compounds derived therefrom by hydrogenation; of the polyol type, such as in particular pentaerythritol; of the alkyl glycoside type, the sorbitan ester type and the natural and synthetic hydrophilic polymer type, in such quantities that the textile treatment preparations may be rapidly dispersed, even in cold water, wherein the dispersion accelerator is present in the reaction mixture during the reaction.

The amide-forming derivatives of aliphatic monocarboxylic acids are understood to be the esters derived from natural or synthetic fatty acids or fatty acid mixtures with lower alkanols, such as for example methanol or ethanol, fatty acid glycerides and fatty acid halides. Examples of such are the derivatives derived from lauric acid, myristic acid, palmitic acid, stearic acid, coconut oil fatty acid, tallow fatty acid or rapeseed oil fatty acid. The reaction products obtainable therefrom by reaction with hydroxyalkylpolyamines are referred to hereinafter as fatty acid condensation products.

Suitable hydroxyalkylpolyamines are preferably derived from the hydroxyalkyl derivatives of ethylenediamine or diethylenetriamine, for example from dihydroxyethylenediamine, hydroxyethyl diethylenetriamine, hydroxypropyl diethylenetriamine and, in particular, from hydroxyethyl ethylenediamine.

Unreacted amino groups may be neutralized with lower carboxylic acid, more especially low molecular weight, organic, optionally hydroxyl-substituted mono- or polycarboxylic acids, such as for example glycolic acid, citric acid, lactic acid or acetic acid.

The monosaccharides of the aldose and ketose type or hydrogenation products thereof useable as dispersion accelerators contain 4, 5 or, in particular, 6 carbon atoms in the molecule. Examples include fructose, sorbose and, in particular, glucose, sorbitol and mannitol which are inexpensively available and very effective. Polyols such as, in particularly, pentaerythritol, dipentaerythritol and trimethylolpropane, are particularly suitable.

Suitable alkylglycosides are obtained by the Fischer process in which monosaccharide is reacted with fatty alcohol in the presence of an acidic catalyst. Alkylglycosides wherein the alkyl group contains up to 16 carbon atoms have long been known as surfactants.

Suitable sorbitan esters include esters with saturated or unsaturated $C_{10}$–$C_{20}$ fatty acids, particularly sorbitan oleate.

Other suitable dispersion accelerators include natural or synthetic hydrophilic polymers. A preferred natural polymer of this class is gelatin. Mixtures of gelatin and monosaccharides or hydrogenation products thereof are particularly suitable. Other suitable natural hydrophilic polymers include, for example, guar, dextrin, gum arabic, agar agar, and casein. Of the synthetic hydrophilic polymers, homopolymers or copolymers based on polyvinylalcohol, polyacrylic acid and polyvinylpyrrolidone are particularly suitable. Suitable polymers are all readily soluble, dispersible, or swellable in water.

The addition of dispersion accelerator required to obtain rapid dispersibility in a short time is in particular in the range from 0.5 to 10% by weight, based on the quantity of dispersion accelerator and fatty acid condensation product. According to the invention, it is important that the dispersion accelerator be present in the reaction mixture during the reaction. The dispersibility of the reaction products is thus further improved in relation to that of known products, above all in cold water. Textile treatment preparations containing as dispersion accelerators monosaccharides and/or hydrogenation products thereof, particularly glucose, sorbitol, mannitol or mixtures thereof, preferably in quantities of 2.5 to 10% by weight, show particularly good properties in the same way as textile treatment preparations containing 5 to 10% by weight of gelatin. The same also applies to preparations containing mixtures of monosaccharides and/or hydrogenation products thereof with gelatin as dispersion accelerators. Preparations containing 1 to 5% by weight of pentaerythritol as a dispersion accelerator also show particularly good properties.

In some cases, the presence of other dispersion aids, for example, fatty alcohol alkoxylates or oxoalcohol alkoxylates containing 10 to 20 carbon atoms in the alcohol component and 2 to 50 mol of alkylene oxide, particularly ethylene oxide and/or propylene oxide, preferably tallow alcohol +50 mol of ethylene oxide or coconut alcohol +5 mol of ethylene oxide +4 mol of propylene oxide, fatty acid partial glycerides and/or water-miscible solvents, such as for example propylene glycol or glycerol, is useful. The quantity of additional dispersion aids in the textile treatment preparations according to the invention may make up from 0.5 to 70% by weight of the textile treatment preparation.

The present invention also relates to a process for the production of the textile treatment preparations. The process according to the invention is characterized in that the fatty acid condensation product is preparted in the presence of dispersion accelerators during the condensation reaction and, optionally, other auxiliaries, and the reaction mixture is subsequently processed to powder or to various shapes, preferably flakes. In the production of the fatty acid condensation products, the fatty acid or the fatty acid derivative and the hydroxyalkyl polyamine are used in a molar ratio of, for example, from 1:1 to 3:1 (carboxylic acid to polyamine). The reaction components are heated together with constant mixing in the presence of the dispersion accelerator until substantially all the fatty acid or fatty acid derivative has reacted. Any unreacted amino groups are then neutralized with low molecular weight organic carboxylic acids or hydroxycarboxylic acids, for example by mixing the melt of the fatty acid condensation product with the calculated quantity of acid to form a salt or by forming the amine salt by dissolving or dispersing the reaction product in the organic acid or in a solution of the organic acid. The acid used for salt formation is used in a stoichiometric quantity or in an excess of up to about 30%. Carrying out the condensation reaction in an inert gas atmosphere and/or in the presence of a reducing agent leads to particularly light-colored products. Hypophosphorous acid has proved to be a particularly effective reducing agent. The textile treatment preparations according to the invention may readily be processed in water, even in cold water, to form stable dispersions. To this end, it is sufficient to mix them with water and then to gently stir the resulting mixture. The dispersions obtained are extremely stable and show no tendency towards separation. The dispersions of textile treatment preparations may be used in various ways for the treatment of fibers, yarns or fabrics. Fibers or yarns may be treatd by conventional textile methods, such as exhausting, spin-extraction, padding or spraying.

Where the textile treatment preparations according to the invention are used in detergents, they provide for improved cleaning and/or softening of the laundry washed therewith. Finally, the textile treatment preparations according to the invention may also be used as a constituent of post-treatment preparations for washed fabrics, making the fabrics soft and antistatic. The post-treatment of the washed fabrics may normally take place in the final rinse, although it may even take place during drying in an automatic tumble dryer, the laundry either being sprayed with a dispersion of the preparation during drying, or the preparation is used in a form in which it is applied to a substrate, for example a flexible sheet-form textile material. The products according to the invention may differ in their composition according to the nature of the textile treatment, i.e., the fatty acid condensation products may have a more or less large fatty acid content or may contain a fatty acid component with fatty acid residues of different length. Products according to the invention containing from 0.7 to 1, preferably saturated, fatty acid residue essentially containing from 16 to 22 carbon atoms to one functional group of the polyamine, i.e. the amino or hydroxyl group, have proved to be particularly effective for the treatment of fibers and yarns and for the aftertreatment of washed fabrics. The aftertreatment preparations according to the invention are also eminently suitable for the production of aqueous fabric softener concentrates which, instead of the usual active substance concentration of about 5% by weight, have an activesubstance concentration of 10 to about 50% by weight. Products containing condensates of relatively short fatty acid residues, i.e. essentially containing 12 to 16 carbon atoms and comprising 0.3 to 1 and preferably 0.3 to 0.5 fatty acid residues per functional group of the hydroxyalkylpolyamine, are preferably selected for use in detergents.

EXAMPLE 1

A fatty acid condensation product known per se suitable for finishing textiles was prepared by heating 850 g (1.0 mol) of hardened beef tallow and 104 g (1.0 mol) of hydroxyethyl ethylenediamine and 48 g of sorbitol under nitrogen for 3.5 hours to 100°-105° C. in a three-necked flask equipped with a stirrer, thermometer, nitrogen inlet pipe and reflux condenser. The reaction was followed by determining the content of amine nitrogen by perchloric acid titration in acetic acid medium. After reaching a content of 0.9% amine nitrogen, the reaction mixture was cooled to 90° C. and the free amino groups were neutralized with glycolic acid. The homogeneoous melt could be converted on a flake-forming roller into yellow, non-sticking flakes having a melting point of about 63° C. This preparation process is referred to as method A, i.e, in accordance with the invention, and the reference is employed in Table 1 which follows herein.

EXAMPLE 2

The procedure was as in Example 1, except that the neutralized melt was mixed with 5% by weight of sorbitol (based on the quantity of product present in accordance with Example 1) only after the reaction. This preparation process is referred to as method B, i.e. according to the prior art, and the reference is also employed in Table 1 which follows herein.

Testing of dispersibility:

1. 5 g samples of the flaked material of Examples 1 and 2 were scattered onto 95 ml of deionized water at 20° C. in a 150 ml glass beaker. Dispersibility was evaluated on the following scale after standing overnight and brief stirring:

1 = finely divided, homogeneous
2 = homogeneous, very few particles
3 = homogeneous, swollen, slightly lumpy
4 = partially swollen, lumpy
5 = almost unchanged, but wetted
6 = unchanged, floating 2. A 5 g sample was again scattered onto 95 ml deionized water at 20° C. in a 150 ml glass beaker. The contents of the beaker were then stirred gently for 5 minutes using a magnetic stirrer and immediately evaluated on the above scale.

The test results obtained with the products of Examples 1 and 2 are shown in Table 1 along with the test results from other products.

EXAMPLES 3 TO 14

Other products according to the invention were prepared in the same way as described in Example 1 with variation of the dispersion accelerator and the acid used for neutralization. Some of the products were compared with prior-art products (method B). The results of the dispersibility test are shown in Table 1 below.

TABLE 1

| Example | Addition (5%) | Neutral. Acid | Method | Evaluation after standing overnight; and stirring | |
|---|---|---|---|---|---|
| 1 | sorbitol | glycolic acid | A | 1–2 | 1 |
| 2 | sorbitol | glycolic acid | B | 3–4 | 5 |
| 3 | sorbitol | acetic acid | A | 2–3 | 2–3 |
| 4 | sorbitol | lactic acid | A | 2–3 | 2 |
| 5 | sorbitol | phosphoric acid | A | 5 | 5 |
| 6 | mannitol | glycolic acid | A | 1–2 | 1–2 |
| 7 | penta-erythritol | glycolic acid | A | 1–2 | 1 |
| 8 | sorbitan | glycolic acid | A | 1–2 | 1 |
| 9 | sorbitan | glycolic acid | B | 2 | 2–3 |
| 10 | $C_{12/14}$ alkyl glucoside | glycolic acid | A | 1 | 1 |
| 11 | sorbitan monooleate | glycolic acid | A | 1 | 1 |
| 12 | sorbitan monooleate | glycolic acid | B | 2–3 | 1 |
| 13 | gelatin | gylcolic acid | A | 1–2 | 1 |
| 14 | PVP | glycolic acid | A | 2 | 1–2 |
| 15 | sorbitol | glycolic acid | A | 1–2 | 1–2 |
| 16 | sorbitol | acetic acid | A | 1–2 | 2 |
| 17 | sorbitol | glycolic acid | A | 1–2 | 1–2 |
| 18 | sorbitol | acetic acid | A | 3 | 2 |
| 19 | sorbitol | acetic acid | B | 5 | 5–6 |

As can be seen, phosphoric acid as neutralizing agent gives unuseable dispersions (Example 5).

EXAMPLE 15

Under the conditions described in Example 1, 561 g (0.66 mol) of hardened beef tallow, 104 g (1.0 mol) of hydroxyethyl ethylenediamine and 30 g of sorbitol were reacted to a residual amine nitrogen content of 1.5% and the free amino groups neutralized with glycolic acid.

EXAMPLE 16

The reaction product obtained in Example 15 was neutralized with acetic acid.

EXAMPLE 17

405 g (1.5 mol) of technical grade stearic acid, 104 g (1.0 mol) of hydroxyethylenediamine, 25 g of sorbitol and 0.5 g of hypophosphorus acid were heated to at most 200° C. in a three-necked flask equipped with a stirrer, thermometer, nitrogen inlet and fractionating column. 28 g of distillate were formed. The acid value (as determined by the DGF method) was 2.8 and the amine nitrogen content 1.35%. After neutralization with glycolic acid, the 90° C. melt was converted into flake form, and had a melting range of 65°–67° C.

EXAMPLE 18

422 g (1.55 mol) of technical grade stearic acid, 422 g (1.25 mol) of technical grade behenic acid, 295 g (1.0 mol) of technical grade tetraethylenepentamine onto which 2 mol of ethylene oxide had been added, 60 g of sorbitol and 1 g of hypophosphorous acid were condensed as in Example 17 to an acid value of 3.5. The residual amino groups (3.2% amine nitrogen) were neutralized with acetic acid and converted into flake form. The product had a melting range of 77°–79° C.

EXAMPLE 19

Example 18 was repeated using method B, i.e. addition of the sorbitol to the condensation product after its preparation.

EXAMPLE 20

Cotton terry fabric was treated by absorption for 20 minutes with a textile treatment liquor containing per liter of water 30 g of a 10% stock liquor which had been prepared by scattering the product of Example 1 into cold water and stirring for 30 minutes at room temperature (liquor ratio 1:20), followed by drying for 3 minutes at 120° C. Cotton/polyester fabric was similarly treated by padding with a liquor which, in addition to typical greaseresistant finishing agents, contained per liter of water 60 g of a 10% stock liquor (prepared as described above) of the product of Example 1, followed by drying. In both cases, the fabrics obtained were not discolored and had a pleasant, soft feel.

EXAMPLE 21

3.0% by weight of a textile treatment preparation according to the invention (Example 17) were added to a standard detergent (IEC test detergent containing perborate, type 1 in the formulation of May, 1976) having the following composition: 6.4% by weight of Na alkylbenzenesulfonate, 2.3% by weight of tallow alcohol +14 mol of ethylene oxide, 2.8% by weight of soap, 35.0% by weight of Na triphosphate, 6.0% by weight of Na silicate, 1.5% by weight of Mg silicate, 1.0% by weight of carboxymethyl cellulose, 0.2% by weight of Na EDTA, 0.2% by weight of optical brightener, 20.0% by weight of Na perborate, 16.8% by weight of Na sulfate and 7.8% by weight of water. Cotton fabrics artificially soiled with make-up cream, mascara and lipstick were washed with this detergent together with ballast laundry. For comparison, correspondingly soiled fabrics were washed in a detergent to which the textile treatment preparation according to the invention had not been added. The test fabrics washed with the detergent containing the addition of the textile treatment preparation according to the invention were distinctly cleaner than the test textiles which had been washed with the detergent without the addition of the textile treatment preparation according to the invention.

EXAMPLE 22

This example describes the composition of a laundry aftertreatment preparation having the following formulation:

- 3.5 % by weight of dimethyldihydrotallowalkyl ammonium chloride
- 2.5 % by weight of the product of Example 1
- 0.5 % by weight of the adduct of stearyl alcohol and approx. 12 mol of ethylene oxide
- 0.05 % by weight of optical brightener for cotton
- 0.07 % by weight of perfume
- 0.0015 % by weight of dye
- 1.25 % by weight of isopropyl alcohol
- 0.5 % by weight of preservative
- balance, water.

To produce this preparation, the solids were mixed at 80° C. in the melt and the melt was stirred into water at 80° C. After the dispersion which formed had cooled, the perfume was added.

To apply the aftertreatment preparation, the washed fabrics were treated in a liquor which contained 3 g of the aftertreatment preparation per liter of water. After drying, the fabrics had a pleasant perfume smell and a full, soft feel.

We claim:

1. A textile treatment preparation obtained by condensation reaction of (a) an aliphatic $C_8$–$C_{22}$ monocarboxylic acid or amideforming derivative thereof with (b) a hydroxyalkyl polyamine and subsequent neutralization of unreacted amino groups, the fabric treatment preparation containing a dispersion accelerator selected from the group consisting of aldose and ketose monosaccharides and polyhydroxy compounds derived therefrom by hydrogenation; a polyol; an alkylglucoside; a sorbitan ester; and a neutral or synthetic hydrophilic polymer, in sufficient quantity so that the textile treatment preparation is rapidly dispersible in cold water, wherein said dispersion accelerator is present in the reaction mixture during the condensation reaction.

2. A textile preparation as in claim 1 containing 0.5 to 10% by weight of said dispersion accelerator, based on the quantity of dispersion accelerator and fatty acid condensation product.

3. A textile treatment preparation as in claim 1 wherein said monosaccharides and hydrogenation products thereof are selected from glucose, sorbitol, mannitol, fructose, sorbose, or mixtures thereof, and are present in a quantity of from about 2.5 to about 10% by weight.

4. A textile treatment preparation as in claim 1 containing gelatin in a quantity of from about 5 to about 10% by weight, as a dispersion accelerator.

5. A textile treatment preparation as in claim 1 containing a mixture of monosaccharides and hydrogenation products thereof with gelatin as a dispersion accelerator.

6. A textile treatment preparation as in claim 1 wherein said polyol comprises pentaerythritol present in a quantity of from about 1 to about 5% by weight.

7. A textile treatment preparation as in claim 1 containing an alkylglycoside as a dispersion accelerator.

8. A textile treatment preparation as in claim 1 containing a sorbitan ester as a dispersion accelerator.

9. A textile treatment preparation as in claim 1 wherein said amideforming derivative comprises an ester derived from a natural or synthetic fatty acid or a fatty acid mixture with a lower alkanol.

10. A textile treatment preparation as in claim 9 wherein said derivative is derived from lauric acid, myristic acid, palmitic acid, stearic acid, coconut oil fatty acid, tallow fatty acid or rapeseed oil fatty acid.

11. A textile treatment preparation as in claim 1 wherein said hydroxyalkyl polyamine is derived from the hydroxyalkyl derivative of ethylenediamine or diethylenetriamine.

12. A textile treatment preparation as in claim 1 wherein said unreacted amino groups are neutralized with a low molecular weight carboxylic acid selected from glycolic acid, citric acid, lactic acid and acetic acid.

13. A textile treatment preparation as in claim 1 wherein said polyol is selected from pentaerythritol, dipentaerythritol and trimethylolpropane.

14. A textile treatment preparation as in claim 1 wherein the alkyl group in said alkyl glucoside contains up to 16 carbon atoms.

15. A textile treatment preparation as in claim 1 wherein said sorbitan ester comprises an ester of a saturated or unsaturated $C_{10}$–$C_{20}$ fatty acid.

16. A process for the production of a textile treatment preparation as in claim 1 wherein the fatty acid condensation products are prepared in the presence of said dispersion accelerator during the condensation reaction and the reaction mixture is subsequently processed to powder or to various shapes.

17. A process as in claim 16 wherein said monocarboxylic acid or amideforming derivative thereof and said hydroxyalkyl polyamine are used in a molar ratio of from about 1:1 to about 3:1, respectively, to form said fatty acid condensation products.

18. The process of softening a textile material comprising contacting said textile with a preparation obtained by condensation reaction of (a) an aliphatic $C_8$-$C_{22}$ monocarboxylic acid or amide-forming derivative thereof with (b) a hydroxyalkyl polyamine and subsequent neutralization of unreacted amino groups, the fabric treatment preparation containing a dispersion accelerator selected from the group consisting of aldose and ketose monosaccarides and polyhydroxy compounds derived therefrom by hydrogenation; a polyol; an alkylglucoside; a sorbitan ester; and a natural or synthetic hydrophilic polymer, in sufficient quantity so that the textile treatment preparation is rapidly dispersible in cold water, wherein said dispersion accelerator is present in the reaction mixture during the condensation reaction.

19. The process of claim 18 wherein said preparation is present during the washing of said textile material.

20. The process of claim 18 wherein said preparation is present during the rinsing of said textile material.

* * * * *

UNITED STATES PATENT AND TRADEMARK OFFICE

CERTIFICATE OF CORRECTION

PATENT NO. : 4,877,539

DATED : October 31, 1989

INVENTOR(S) : Uwe Ploog et al.

It is certified that error appears in the above-identified patent and that said Letters Patent is hereby corrected as shown below:

In Claim 1, at Column 7, line 66, "neutral" should read --natural--.

Signed and Sealed this

Fifth Day of February, 1991

*Attest:*

HARRY F. MANBECK, JR.

*Attesting Officer*

*Commissioner of Patents and Trademarks*